US008177354B2

(12) United States Patent
Sawada

(10) Patent No.: US 8,177,354 B2
(45) **Date of Patent: *May 15, 2012**

(54) RECORDING DEVICE

(75) Inventor: Keishi Sawada, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 419 days.

This patent is subject to a terminal disclaimer.

(21) Appl. No.: 12/410,197

(22) Filed: Mar. 24, 2009

(65) Prior Publication Data

US 2009/0244244 A1 Oct. 1, 2009

(30) Foreign Application Priority Data

Mar. 25, 2008 (JP) ..... 2008-077457
Mar. 25, 2008 (JP) ..... 2008-077458
Dec. 22, 2008 (JP) ..... 2008-325105

(51) Int. Cl.
*B41J 2/01* (2006.01)

(52) U.S. Cl. ..... 347/104; 347/101

(58) Field of Classification Search ..... 347/103, 347/102, 101, 104, 100
See application file for complete search history.

(56) References Cited

U.S. PATENT DOCUMENTS

| | | | | |
|---|---|---|---|---|
| 6,270,074 | B1 | 8/2001 | Rasmussen et al. | |
| 6,406,017 | B1 * | 6/2002 | Yaneda | 271/196 |
| 6,964,468 | B2 * | 11/2005 | Kitahara et al. | 347/42 |
| 6,981,766 | B2 | 1/2006 | Tsuji | |
| 7,093,933 | B2 * | 8/2006 | Tsuji et al. | 347/104 |
| 7,354,147 | B2 * | 4/2008 | Beehler | 347/104 |
| 2007/0126832 | A1 | 6/2007 | Kito | |

FOREIGN PATENT DOCUMENTS

| | | |
|---|---|---|
| JP | 04-085234 | 3/1992 |
| JP | 10-315551 | 12/1998 |
| JP | 2003-159841 | 6/2003 |
| JP | 2004-018151 | 1/2004 |

OTHER PUBLICATIONS

U.S. Appl. No. 12/407,060, Mar. 30, 2011, Office Action.
U.S. Appl. No. 12/407,060, Aug. 24, 2011, Notice of Allowance.

* cited by examiner

*Primary Examiner* — Manish S Shah
(74) *Attorney, Agent, or Firm* — Workman Nydegger

(57) ABSTRACT

A recording device includes: a first suction unit which has a support member for supporting a recording medium and a plurality of suction holes provided in the support member to support the recording medium under control that a second suction force of the suction holes not covered by the recording medium is restricted to be smaller than a first suction force of the suction holes covered by the recording medium; a recording head which performs recording on the recording medium supported by the first suction unit.

4 Claims, 11 Drawing Sheets

RECORDING DEVICE

BACKGROUND

1. Technical Field

The present invention relates to a recording device, and more particularly, to a recording device which performs recording by ejecting ink onto a recording medium sucked and transported on a transport member.

2. Related Art

There has been known a recording device using an ink jet recording head (see JP-A-10-315551). In the recording device, a recording medium is sucked onto a transport belt by a suction force of through holes formed in the transport belt to be transported to a recording area. In this manner, floating of the recording medium from the transport belt is suppressed.

However, in the recording device, airflow is generated by the suction force of the through holes not blocked by the recording medium in the recording area of the recording head. The air flow affects a flight state of ink droplets. When the suction force of the through holes is decreased to stabilize the flight state of ink droplets, the floating of the recording medium from the transport belt cannot be sufficiently suppressed. Particularly, since the suction of the recording medium onto the transport belt is started on the upstream side of the recording area in a transport direction, the floating of the recording medium from the transport belt easily occurs.

SUMMARY

According to an aspect of the invention, there is provided a recording device including: a first suction unit which has a support member for supporting a recording medium and a plurality of suction holes provided in the support member to support the recording medium under control that a second suction force of the suction holes not covered by the recording medium is restricted to be smaller than a first suction force of the suction holes covered by the recording medium; a recording head which performs recording on the recording medium supported by the first suction unit; and a second suction unit which has a support member for supporting a recording medium and a plurality of suction holes provided in the support member and is disposed near the first suction unit in a transport direction of the recording medium and in which a third suction force of the suction holes not covered by the recording medium is set to be larger than the second suction force. Accordingly, an effect of airflow on a flight state of ink droplets can be suppressed and floating of a recording medium from the support member can be sufficiently suppressed.

In the recording device, the second suction unit may be disposed on the upstream side of the first suction unit in the transport direction to feed a recording medium to the first suction unit. In the recording device, the second suction unit may be disposed on the downstream side of the first suction unit in the transport direction to transport a recording medium on which recording has been performed by the recording head.

In the recording device, each of the first suction unit and the second suction unit may have a plurality of communication channels communicating a suction force generating section which generates a suction force for sucking air with the suction holes, and a suction force adjusting section provided to correspond to the suction holes and restricting the first suction force to be smaller than the second suction force, the communication channel may have: a hole-side channel section which is closer to the suction hole than the suction force adjusting section; and a suction-side channel section which is closer to the suction force generating section than the suction force adjusting section, the suction force adjusting section may have: a diaphragm which is arranged between the hole-side channel section and the suction-side channel section and is displaced toward the hole-side channel section or the suction-side channel section by a differential pressure between the hole-side channel section and the suction-side channel section; an open-close communication hole which is formed in the diaphragm, is opened and closed by the displacement of the diaphragm and communicates the hole-side channel section with the suction-side channel section in an opened state; and an open communication hole which is formed in the diaphragm, is opened regardless of the position of the diaphragm and communicates the hole-side channel section with the suction-side channel section, and a hole diameter of the open communication hole disposed in the recording area may be smaller than a hole diameter of the open communication hole disposed on the upstream side of the recording area in the transport direction. Accordingly, a channel cross-sectional area of some of the communication channels communicating with the suction holes opened in the recording area can be made narrower than that on the upstream side or the downstream side of the recording area in the transport direction. As a result, a recording medium on the upstream side or the downstream side in the transport direction can be sufficiently sucked onto the support member to sufficiently suppress floating of the recording medium from the support member, and airflow generated in the recording area can be weakened to suppress an effect of the airflow on a flight state of ink droplets.

In the recording device, each of the first suction unit and the second suction unit may have a plurality of communication channels communicating a suction force generating section which generates a suction force for sucking air with the suction holes, and suction force adjusting sections provided to correspond to the suction holes and restricting the first suction force to be smaller than the second suction force, and the number of the suction force adjusting sections of the first suction unit may be larger than the number of the suction force adjusting sections of the second suction unit. Accordingly, the number of the suction holes, the suction force of which is decreased by the suction force adjusting sections, among the opened suction holes is larger in the recording area than on the upstream side or the downstream side of the recording area in the transport direction. Therefore, airflow generated in the recording area can be made weaker than airflow generated on the upstream side or the downstream side of the recording area in the transport direction.

The recording device may further include a suction force generating section which generates a suction force for sucking air, each of the first suction unit and the second suction unit may have a plurality of communication channels communicating the suction force generating section with the suction holes, and a suction force adjusting section provided to correspond to the suction holes and restricting the first suction force to be smaller than the second suction force, the first suction unit may have a first chamber in which the communication channels communicating with the suction holes are disposed, the second suction unit may have a second chamber in which the communication channels communicating with the suction holes are disposed, and the suction force generating sections may be provided to correspond to the first chamber and the second chamber, respectively. Accordingly, a suction force generated in the suction holes blocked by a recording medium can be made stronger than in the case where a suction force is generated in the first chamber and the second chamber by one suction force generating section, and thus the recording medium can be stably sucked onto the transport member.

According to another aspect of the invention, there is provided a recording device including: a recording head which performs recording by ejecting ink on a recording medium; a transport member which has a plurality through holes formed therein to transport the recording medium to a recording area of the recording head; a suction unit which has a suction force generating section which generates a suction force for sucking air and a plurality of communication channels which communicate the suction force generating section with the through holes, and sucks the recording medium onto the transport member by generating a suction force in the through holes; and a suction force adjusting section which is provided to correspond to at least the through holes positioned in the recording area and restricts a suction force of the through holes opened to be smaller than a suction force of the through holes blocked by the recording medium, and by the suction force adjusting section, the suction force generated in the opened through holes positioned in the recording area can be made weaker than the suction force generated in the opened through holes positioned on the upstream side or the downstream side of the recording area in the transport direction. Accordingly, airflow generated in the recording area can be weakened to suppress an effect of the airflow on a flight state of ink droplets, and a suction force between a recording medium and the transport member on the upstream side or the downstream side of the recording area in the transport direction can be sufficiently ensured to sufficiently suppress floating of the recording medium at the stage where suction is started or after recording from the transport member.

In the recording device, when the through holes are blocked by a recording medium, the suction force adjusting section may increase a channel cross-sectional area of the communication channels communicating with the through holes, and when the through holes are opened, the suction force adjusting section may decrease a channel cross-sectional area of the communication channels communicating with the through holes. Accordingly, without controlling a drive force of the suction force generating section, the suction force of the through holes can be increased when the through holes are blocked by the recording medium, and the suction force of the through holes can be decreased when the through holes are opened.

In the recording device, by the suction force adjusting section, a channel cross-sectional area of the communication channels communicating with the opened through holes positioned in the recording area may be made narrower than a channel cross-sectional area of the communication channels communicating with the opened through holes positioned on the upstream side of the recording area in the transport direction. Accordingly, the suction force generated in the opened through holes in the recording area can be made weaker than that on the upstream side of the recording area in the transport direction.

In the recording device, some of the suction force adjusting sections may be disposed on the upstream side of the recording area in the transport direction. Accordingly, on the upstream side of the recording area in the transport direction, suction amounts from the opened through holes can be decreased without decreasing the suction force of the through holes blocked by the recording medium. Thus, on the upstream side of the recording area in the transport direction, floating of the recording medium from the transport member can be sufficiently suppressed and airflow generated in the opened through holes can be weakened to suppress an effect of the airflow on a flight state of ink droplets.

The above description of the invention does not include all the features of the invention and subcombinations of the features can construct the invention.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be described and the following embodiments do not limit the invention, which is defined in the claims. In addition, all the combinations of features described in the embodiments are not essential to the invention.

Figure 1:
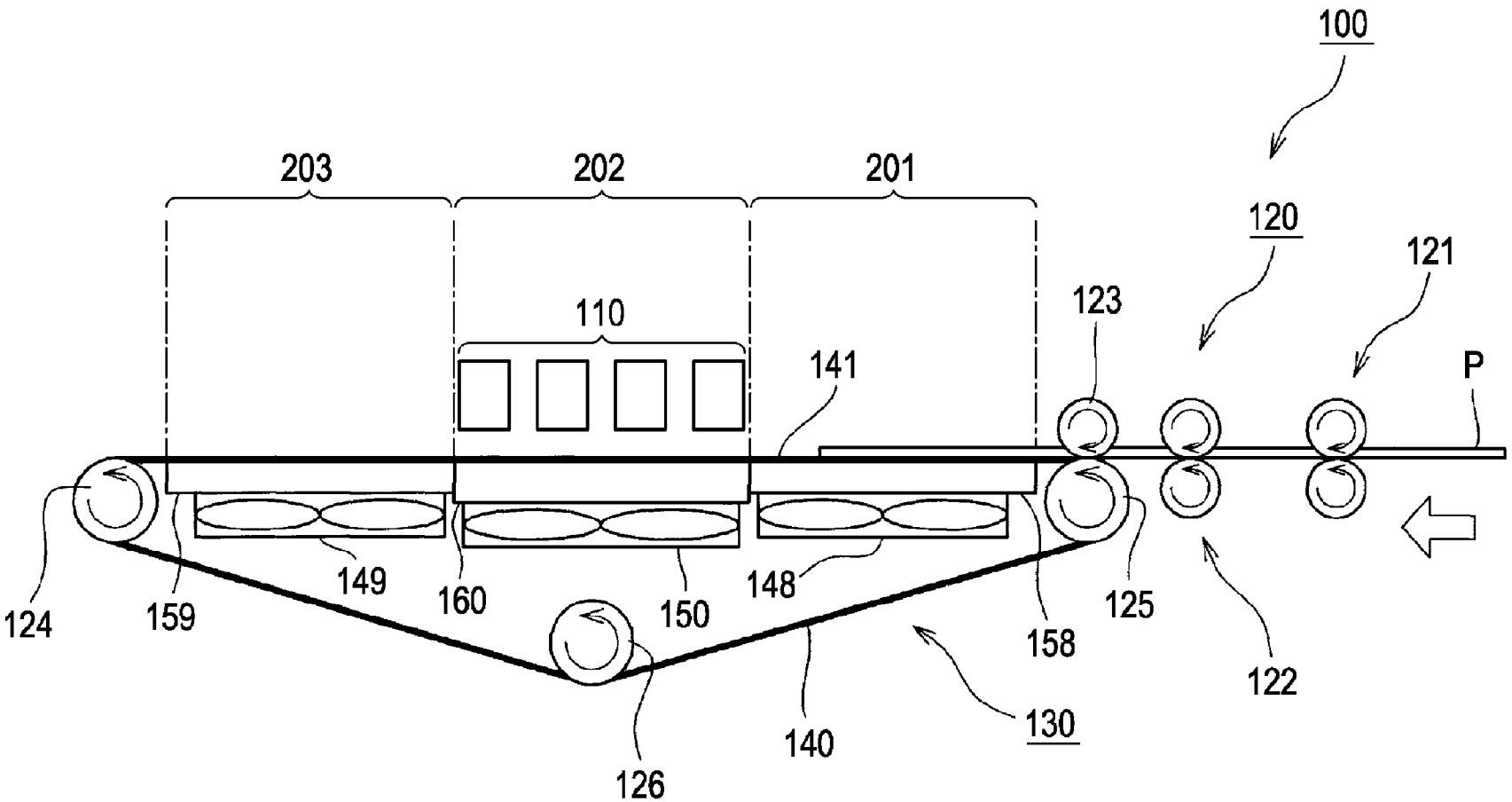
FIG. 1 is a side view illustrating the schematic structure of a recording device.

FIG. 1 is a side view illustrating the schematic structure of an ink jet recording device 100 according to this embodiment. As illustrated in the drawing, the recording device 100 has a transport unit 120 which transports a sheet P as a recording medium and plural recording heads 110 which eject ink onto the sheet P to perform a recording operation.

The transport unit 120 has a drive roller 124, driven rollers 125 and 126 and an endless transport belt 140 as a transport member extended over the rollers. The drive roller 124 and the driven roller 125 are substantially horizontally arranged. The driven roller 126 is arranged below a middle position in-between the drive roller 124 and the driven roller 125. That is, the transport belt 140 is made to extend in a substantially triangular shape by the drive roller 124 and the driven rollers 125 and 126 and a part of the transport belt 140 (hereinafter, referred to as "upper face 141") is made to substantially horizontally extend by the drive roller 124 and the driven roller 125. A transport drum can be also applied as the transport member.

The plural recording heads 110 are arranged to be opposed to the upper face 141 of the transport belt 140. On the upstream side of the transport unit 120 in a transport direction, a feed roller 121, a gate roller 122 and a sheet pressing roller 123 are sequentially arranged from the upstream side in the transport direction. The sheet P is transported to the transport unit 120 by the rollers.

The transport unit 120 has a sheet sucking device 130 as a suction unit. The sheet sucking device 130 has fans 148, 150 and 149 as a suction force generating section, an upstream chamber 158, a recording area chamber 160 and a downstream chamber 159. The fans 148, 150 and 149 are sequentially arranged in the transport direction on an inner circumferential side of the transport belt 140. The upstream chamber 158 is arranged between the upper face 141 and the fan 148. Similarly, the recording area chamber 160 is arranged between the upper face 141 and the fan 150, and the downstream chamber 159 is arranged between the upper face 141 and the fan 149.

The upstream chamber 158 and the fan 148 are arranged in an upstream area 201 on the upstream side of a recording area 202 of the recording heads 110. The recording area chamber 160 and the fan 150 are arranged to be opposed to the recording area 202 of the recording heads 110. The downstream chamber 159 and the fan 149 are arranged in a downstream area 203 on the downstream side of the recording area 202 of the recording heads 110.

Figure 2:
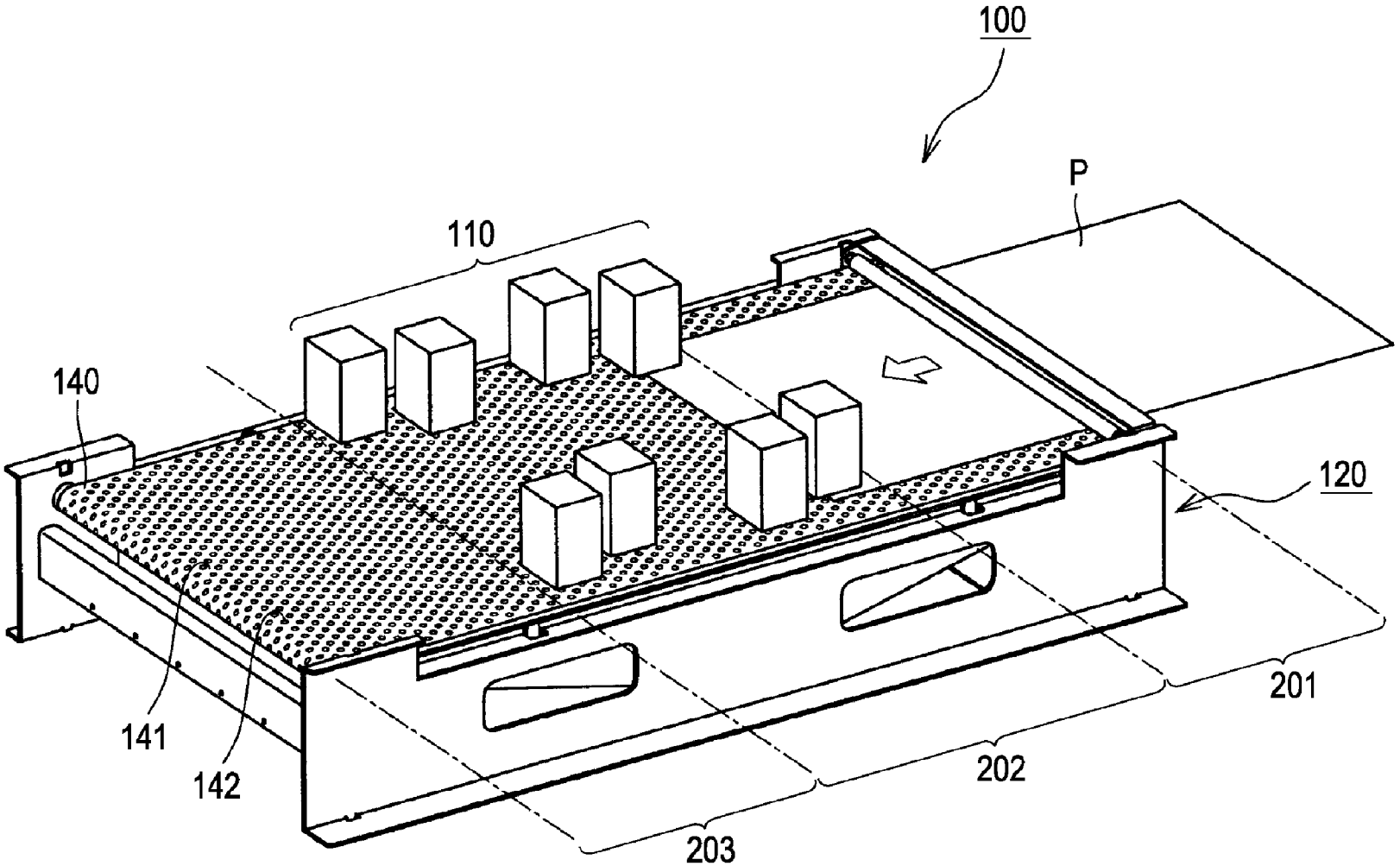
FIG. 2 is a perspective view illustrating the inner structure of the recording device.

FIG. 2 is a perspective view illustrating the inner structure of the recording device 100. As illustrated in the drawing, each of the recording heads 110 is shorter than a width of the sheet P and they are vertically and horizontally arranged in a direction perpendicular to the transport direction (hereinafter, referred to as "sheet width direction") and the transport direction. The plural recording heads 110 are arranged in a zigzag manner in the transport direction.

Plural through holes 142 are vertically and horizontally arranged in the sheet width direction and the transport direction over the entire area of the transport belt 140. The plural through holes 142 are arranged in a zigzag manner in the transport direction.

Figure 3:
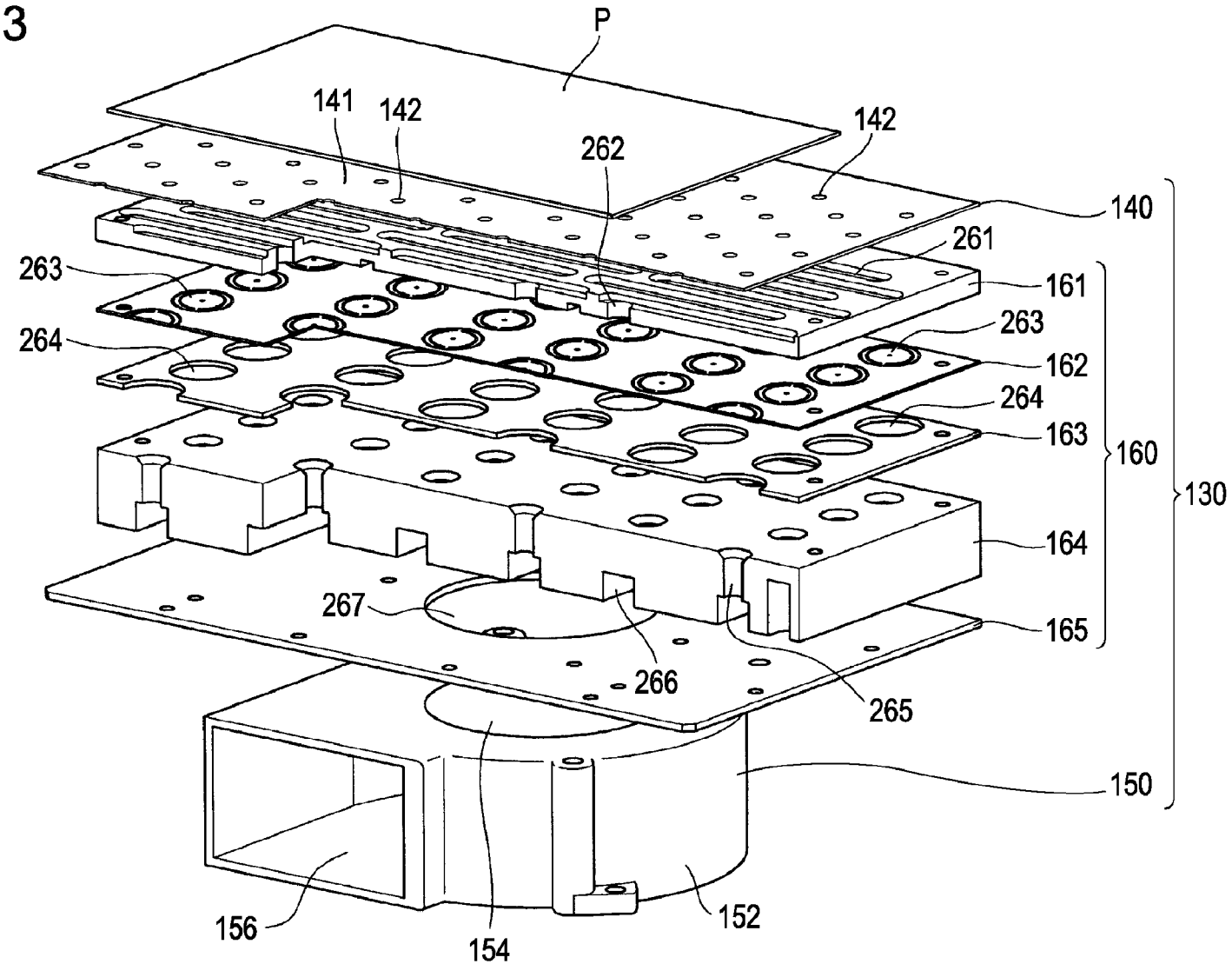
FIG. 3 is an exploded perspective view illustrating a fan and a recording area chamber in a sheet sucking device.

FIG. 3 is an exploded perspective view illustrating the fan 150 and the recording area chamber 160 in the sheet sucking device 130. Since the fans 148 and 149 and the upstream and downstream chambers 158 and 159 have the same structure as the fan 150 and the recording area chamber 160, respectively, a description thereof will be omitted.

As illustrated in the drawing, the fan 150 has a housing 152 and a blade arranged in the housing 152. A circular intake port 154 is formed in a face of the housing 152 on the side of the recording area chamber 160. An exhaust port 156 is formed in a side face of the housing 152. Other than the fan 150, a blower, a pump or the like can be applied as the suction force generating section.

The recording area chamber 160 has a belt receiving plate 161, a valve plate 162, a spacer plate 163, a body 164 and a sealing plate 165. The belt receiving plate 161, the valve plate 162, the spacer plate 163, the body 164 and the sealing plate 165 are sequentially laminated in a direction from the upper face 141 toward the fan 150.

In the belt receiving plate 161, plural elliptical grooves 261, the longitudinal direction of which is the transport direction, are vertically and horizontally arranged in the transport direction and the sheet width direction. The plural grooves 261 are arranged in a zigzag manner in the sheet width direction.

A hole-side channel section 262 is formed at the bottom of the groove 261. The hole-side channel section 262 is formed of a circular through hole. In this embodiment, each groove 261 is provided with one hole-side channel section 262. However, each groove 261 may be provided with plural hole-side channel sections 262.

In the valve plate 162, plural circular valves 263 are formed. The valves 263 are arranged so as to overlap the hole-side channel sections 262. In the spacer plate 163, plural valve chambers 264 are formed. The valve chambers 264 are formed of circular through holes. The hole-side channel sections 262 and the valves 263 are arranged so as to overlap each other. A diameter of the hole-side channel section 262 is equal to a diameter of the valve 263.

The body 164 is provided with plural suction-side channel sections 265. The suction-side channel sections 265 are formed of circular through holes. The suction-side channel sections 265 and the valves 263 are arranged so as to overlap each other. A diameter of the suction-side channel section 265 is smaller than a diameter of the valve 263. A lower portion of the body 164 is provided with a channel 266 which communicates the plural suction-side channel sections 265 with each other.

In the sealing plate 165, a circular through hole 267 is formed so as to overlap the intake port 154 of the fan 150. A diameter of the through hole 267 is equal to a diameter of the intake port 154. The intake port 154 and the channel 266 communicate with each other via the through hole 267.

Figure 4:
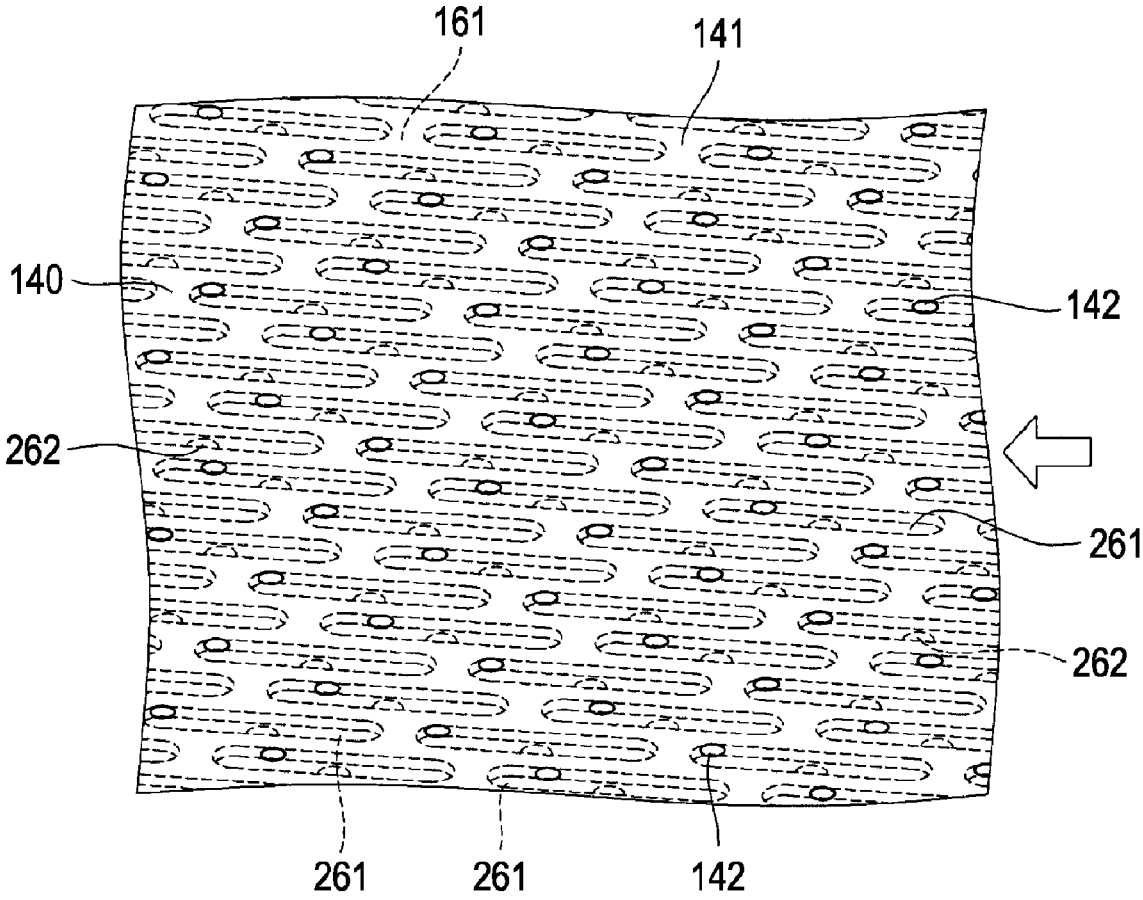
FIG. 4 is an enlarged perspective view illustrating a transport belt and a belt receiving plate.

FIG. 4 is an enlarged perspective view illustrating the transport belt 140 and the belt receiving plate 161. As illustrated in the drawing, the grooves 261 are arranged so as to overlap the arrays of the through holes 142 arranged in the transport direction. A length of the groove 261 in the transport direction is equal to an interval between the through holes 142 aligned in the transport direction. Accordingly, the groove 261 is provided so as to overlap any through hole 142 when the transport belt 140 moves.

Figure 5:
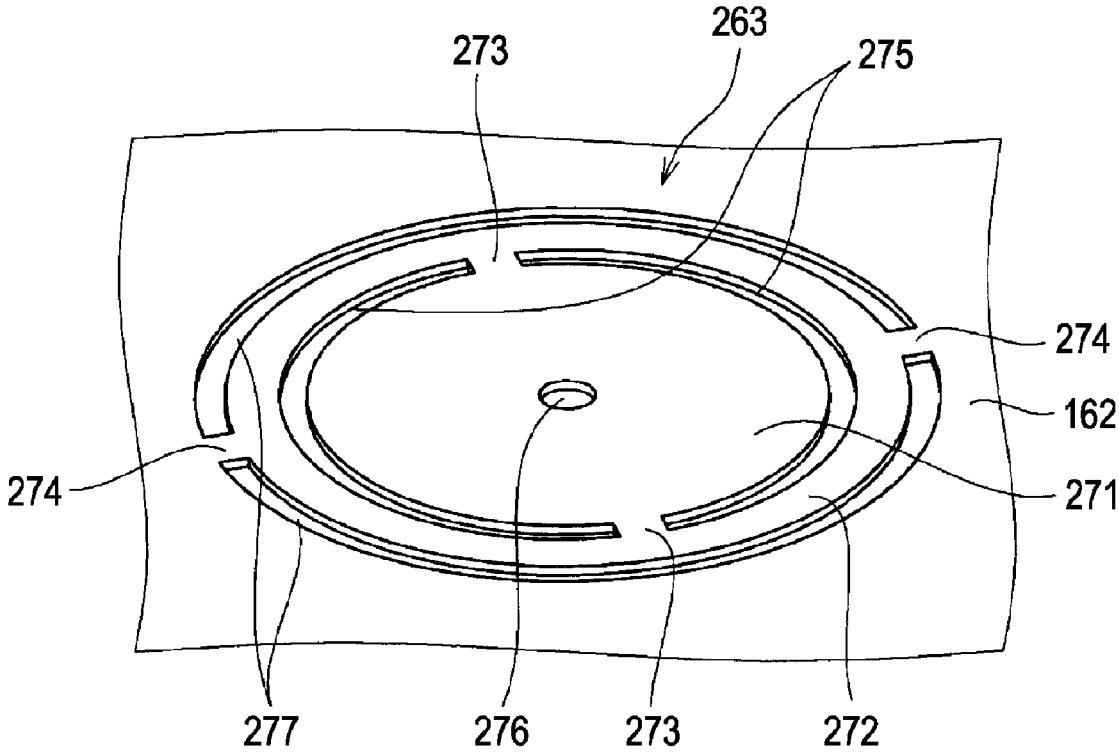
FIG. 5 is a perspective view illustrating a valve.

FIG. 5 is a perspective view illustrating the valve 263. As illustrated in the drawing, the valve 263 has a diaphragm 271, a support section 272, a pair of arms 273, a pair of arms 274, a pair of slits 275 as an open-close communication hole and an open communication hole 276. The diaphragm 271 is formed in a circular shape. The pair of slits 275 having a semicircular shape is formed around the diaphragm 271 to be symmetrical to each other with respect to the center of the diaphragm 271. The open communication hole 276 is formed at the center of the diaphragm 271.

The support section 272 having a circular shape is arranged around the pair of slits 275. The diaphragm 271 is supported at both sides by the pair of arms 273 provided between the opposite ends of the pair of slits 275. A pair of semicircular slits 277 is formed around the support section 272 to be symmetrical to each other with respect to the open communication hole 276. The support section 272 is supported at the valve plate 162 at both sides by the pair of arms 274 provided between the opposite ends of the pair of slits 277.

Herein, the opposite ends of the slit 275 and the opposite ends of the slit 277 are arranged around the open communication hole 276 with their phases shifted by 90°. Moreover, the arms 273 and 274 are arranged around the open communication hole 276 with their phases shifted by 90°. That is, the valve 263 has a so-called gimbal structure. The valve plate 162 is made of an elastically deformable metal material or a resin material. The valve 263 is formed by etching or punching of metal or molding or punching of resin.

Figure 6:
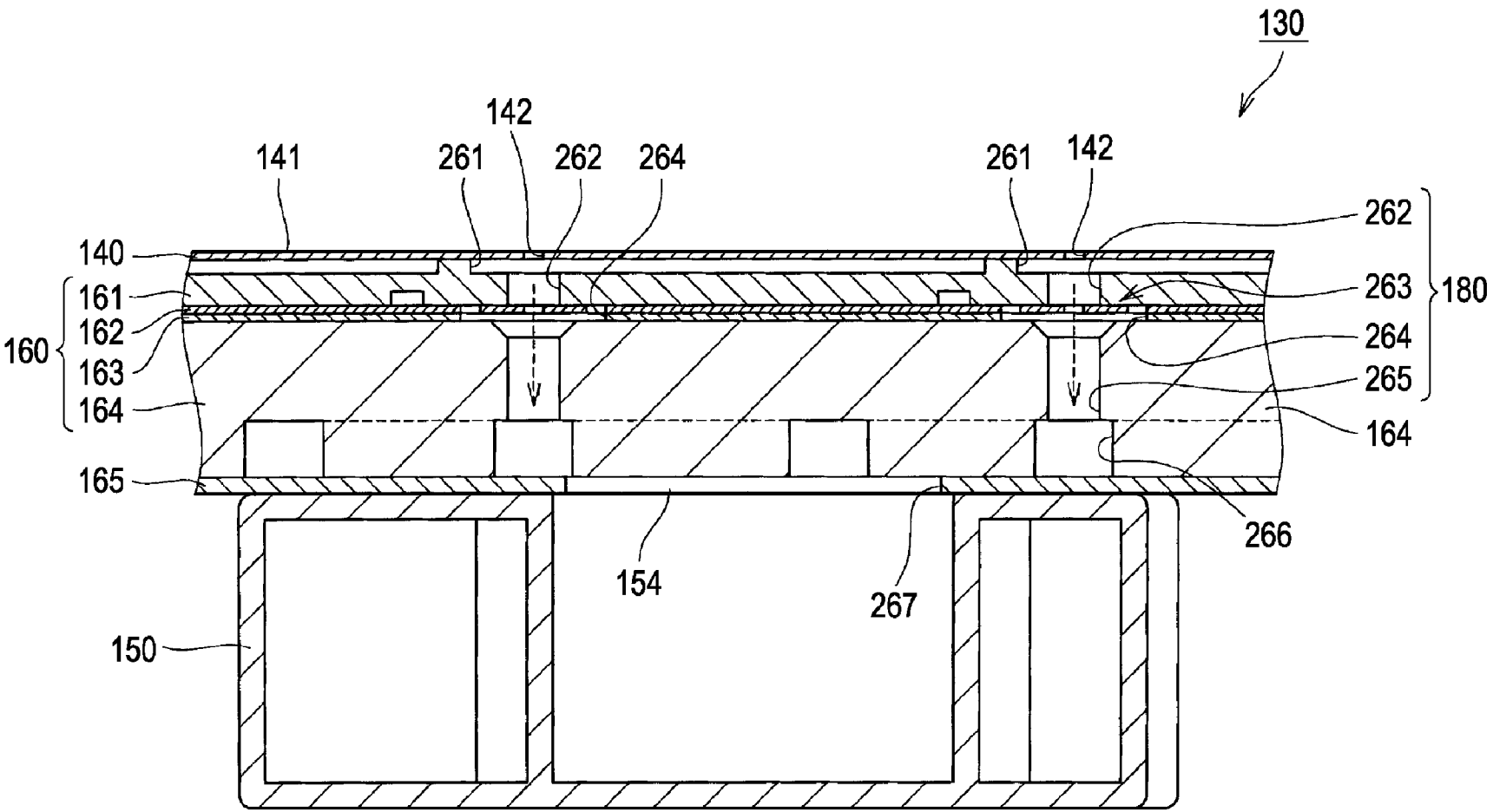
FIG. 6 is a partial sectional view illustrating the sheet sucking device.

FIG. 6 is a partial sectional view illustrating the sheet sucking device 130. As illustrated in the drawing, the hole-side channel section 262, the open communication hole 276, the valve chamber 264 and the suction-side channel section 265 are arranged so that axial centers thereof are aligned on the same straight line indicated by the dashed line in the drawing. Accordingly, a communication channel 180 communicating the through hole 142 with the fan 150 is formed.

A diameter of the diaphragm 271 is larger than a diameter of the hole-side channel section 262 and a diameter of the suction-side channel section 265. Thus, the slit 275 is positioned closer to the outer diameter side than the hole-side channel section 262 and the suction-side channel section 265. Accordingly, as illustrated in the drawing, when the diaphragm 271 is flush with the valve plate 162, the slit 275 is blocked by the belt receiving plate 161.

Figure 7:
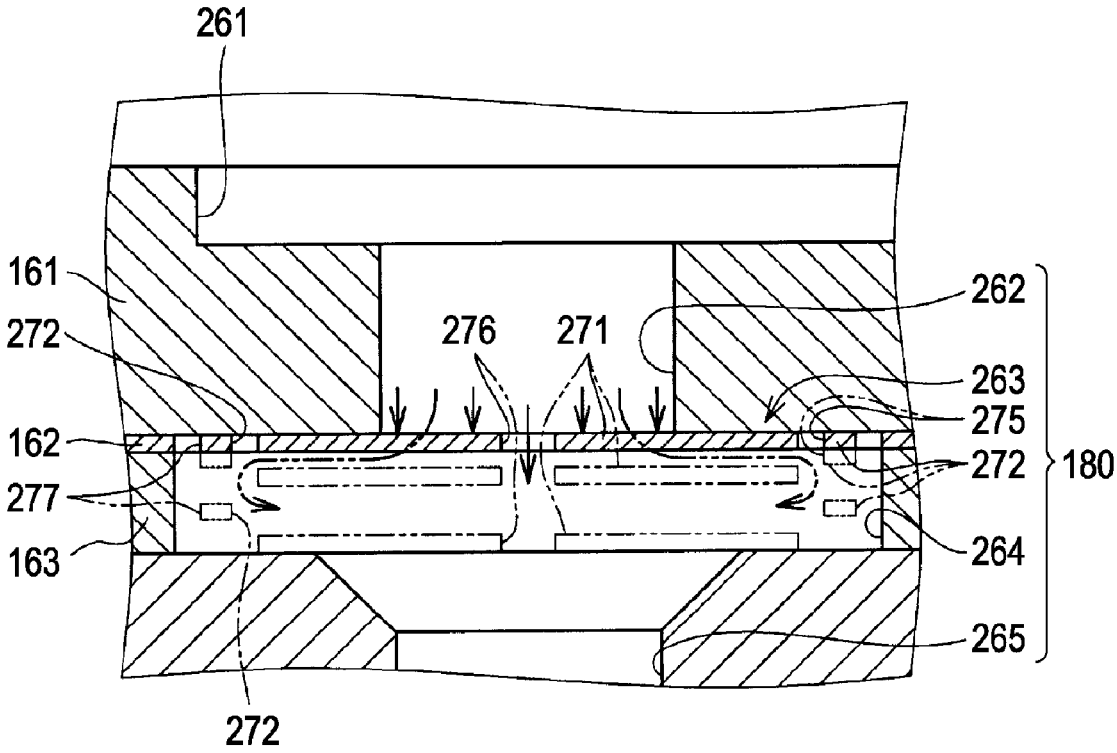
FIG. 7 is a schematic sectional side view illustrating the operation of the valve and air flows in a communication channel.

FIG. 7 is a schematic sectional side view illustrating the operation of the valve 263 and air flows in the communication channel 180. As indicated by the chain double-dashed lines in the drawing, when the suction-side channel section 265 has a negative pressure lower than that of the hole-side channel section 262 due to driving of the fan 150, the diaphragm 271 elastically deforms the arm 273 toward the suction side to displace the arm 273 toward the suction side.

When the through hole 142 is not blocked by the sheet P, the pressure in the hole-side channel section 262 is approximately atmosphere pressure and the suction-side channel section 265 has a negative pressure. Therefore, a differential pressure between the sections increases. In this pressure state, the diaphragm 271 moves downward up to the lowest position of the valve chamber 264 to be brought into contact with an upper face of the body 164. Accordingly, the slit 275 is blocked by the upper face of the body 164 and thus all of the air flows in the communication channel 180 pass through the open communication hole 276.

On the other hand, when the through hole 142 is blocked by the sheet P, the pressure in the hole-side channel section 262 becomes a negative pressure and thus a differential pressure between the hole-side channel section 262 and the suction-side channel section 265 decreases. In this pressure state, the diaphragm 271 is stopped at a position in which a restoring force caused by the elasticity of the arms 273 and 274 is balanced with a force of the air flows in the communication channel 180 pressing the diaphragm 271.

Herein, the position at which the diaphragm 271 is stopped is an intermediate position between the highest position and the lowest position of the valve chamber 264 and the slit 275 is opened. Accordingly, the air flows in the communication channel 180 pass through the open communication hole 276 and the slit 275.

That is, when the through hole 142 is opened, a channel cross-sectional area of the valve chamber 264 decreases, and when the through hole 142 is blocked, the channel cross-sectional area of the valve chamber 264 increases. Accordingly, when the through hole 142 is opened, a suction force generated in the through hole 142 decreases. However, when the through hole 142 is blocked, a suction force generated in the through hole 142 increases.

When the open communication hole 276 is not formed in the diaphragm 271, the diaphragm 271 completely blocks the communication channel 180 in a state in which the through hole 142 is not blocked by the sheet P. Accordingly, even when the through hole 142 is subsequently opened, the pressure in the hole-side channel section 262 is not lowered from the atmosphere pressure, and thus the suction from the through hole 142 does not occur and the sheet P is not sucked onto the transport belt 140.

Figure 8:
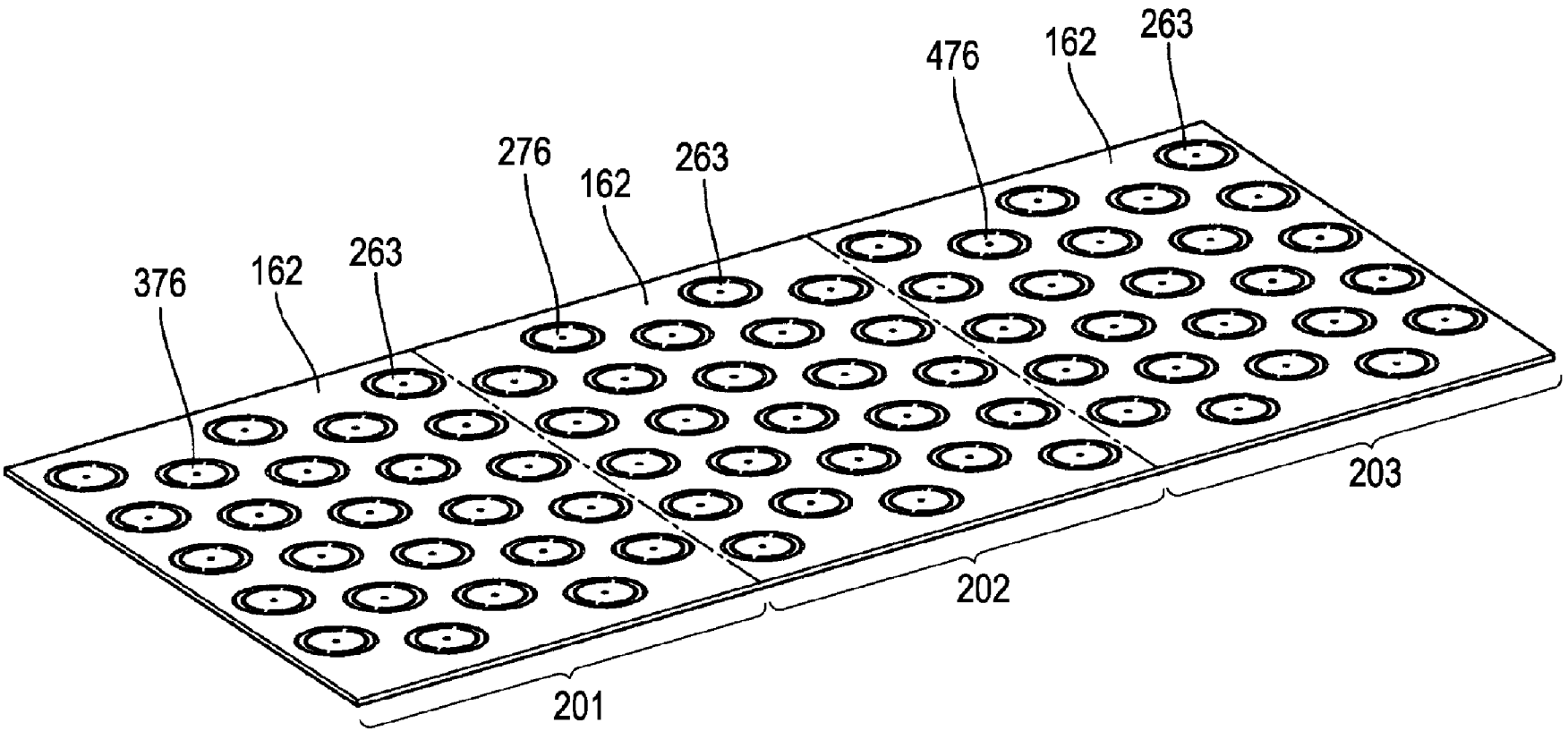
FIG. 8 is a perspective view illustrating valve plates disposed in an upstream chamber, a recording area chamber and a downstream chamber.

FIG. 8 is a perspective view illustrating the valve plates 162 disposed in the upstream chamber 158, the recording area chamber 160 and the downstream chamber 159. As illustrated in the drawing, the valve plate 162 disposed in the recording area 202 is provided with the open communication holes 276. The valve plate 162 disposed in the upstream area 201 is provided with open communication holes 376, and the valve plate 162 disposed in the downstream area 203 is provided with open communication holes 476.

Figure 9A:
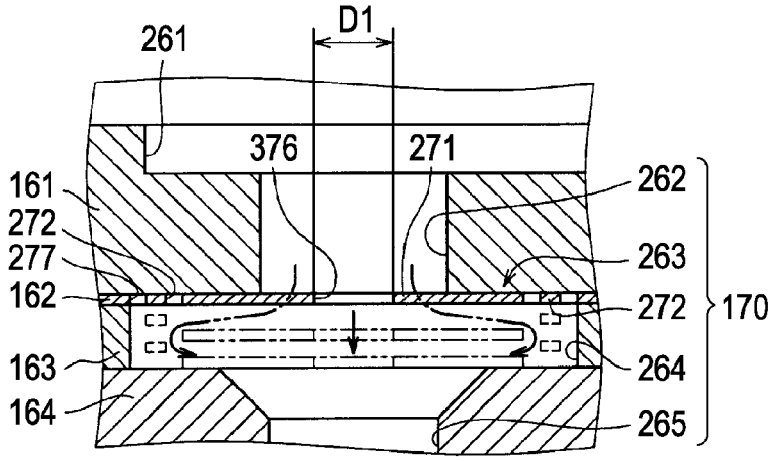
FIGS. 9A to 9C are partial sectional side views illustrating the upstream chamber, the recording area chamber and the downstream chamber.
Figure 9B:
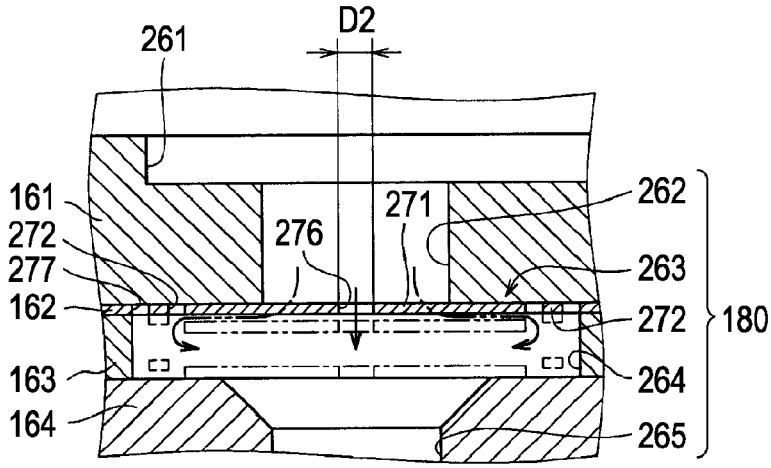
Figure 9C:
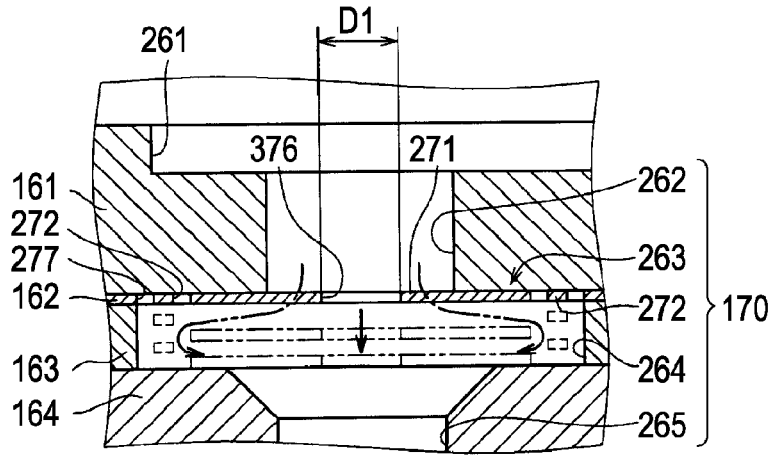

FIGS. 9A to 9C are partial sectional side views illustrating the upstream chamber 158, the recording area chamber 160 and the downstream chamber 159. As illustrated in FIGS. 9A and 9C, hole diameters of the open communication holes 376 and 476 formed in the valve plate 162 disposed in the upstream chamber 158 and the downstream chamber 159 are D1. As illustrated in FIG. 9B, a hole diameter of the open communication hole 276 formed in the valve plate 162 disposed in the recording area chamber 160 is D2, which is smaller than D1.

Next, actions of the embodiment will be described. In the recording device 100, when a print job is started, the sheet P is transported to a nip section between the driven roller 125 and the sheet pressing roller 123 by the feed roller 121 and the gate roller 122. The sheet P is pressed onto the transport belt 140 while passing through the nip section.

In the upstream area 201, the sheet P pressed onto the transport belt 140 is sucked onto the upper face 141 of the transport belt 140 by a suction force generated in the through holes 142 by the fan 148, and is transported to the recording area 202 by the rotation of the transport belt 140. In the recording area 202, the sheet P is sucked onto the upper face 141 of the transport belt 140 by a suction force generated in the through holes 142 by the fan 150, and is transported by the transport belt 140. At this time, recording is performed on the sheet P by ejecting ink from the recording heads 110. The sheet P on which the recording operation has been performed is sucked onto the upper face 141 of the transport belt 140 by a suction force generated in the through holes 142 by the fan 149 in the downstream area 203, and is transported to the downstream side of the transport belt 140 to be discharged from the recording device 100.

Herein, while the sheet P is transported to the upstream area 201, the recording area 202 and then the downstream area 203, the through holes 142 of the areas are opened. Thus, each of the diaphragms 271 blocks the slit 275 at the lowest position of the valve chamber 264. Accordingly, the air channel for the valve chamber 264 becomes a first channel passing through the open communication hole 276 and a channel cross-sectional area of the valve chamber 264 becomes minimum in a changeable range.

When the sheet P is transported to the areas, the through holes 142 positioned outside of the transport areas for the sheet P in the areas are opened, so the channel cross-sectional area of the valve chambers 264 communicating with the through holes 142 does not change. On the other hand, the through holes 142 positioned in the transport areas for the sheet P in the areas are blocked by the sheet P, so inner pressures in the hole-side channel sections 262 communicating with the through holes 142 are lowered and thus a differential pressure between the hole-side channel section 262 and the suction-side channel section 265 decreases. Accordingly, the diaphragm 271 is displaced toward the hole-side channel section 262 and the slit 275 is opened. Thus, the air channel for the valve chamber 264 becomes a second channel passing through the open communication hole 276 and the slit 275 and the channel cross-sectional area of the valve chambers 264 increases.

As hole diameters of the open communication holes 276, 376 and 476 increase, air suction amounts from the open communication holes 276, 376 and 476 when the through holes 142 are blocked by the sheet P and opened increase.

Accordingly, promptness of the change in inner pressure of the hole-side channel section 262 increases and thus responsiveness of the diaphragm 271 is improved. In addition, since the air suction amounts from the open communication holes 276, 376 and 476 increase, airflow generated outside the opened open communication holes 276, 376 and 476 becomes strong and thus has an effect on a flight state of the ink.

Herein, the hole diameter of the open communication hole 276 arranged in the recording area 202 is D2 and the hole diameters of the open communication holes 376 and 476 arranged in the upstream area 201 and the downstream area 203 are D1, which is larger than D2. Accordingly, the responsiveness of the diaphragms 271 when the through holes 142 are blocked by the sheet P is more rapid in the upstream area 201 and the downstream area 203 than in the recording area 202. Accordingly, when the sheet P is transported to the vicinity of the through holes 142, the negative pressures of the hole-side channel sections 262 communicating with the through holes 142 are more rapidly generated in the upstream area 201 and the downstream area 203 than in the recording area 202.

Since the channel cross-sectional area of the valve chambers 264 communicating with the opened through holes 142 are narrower in the recording area 202 than in the upstream area 201 and the downstream area 203, the air suction amounts from the opened through holes 142 become smaller in the recording area 202 than in the upstream area 201 and the downstream area 203. Accordingly, airflow generated around the opened through holes 142 in the recording area 202 is weaker than airflow generated around the opened through holes 142 in the upstream area 201 and the downstream area 203.

As described above, the air suction amounts from the through holes 142 which are opened in the recording area 202 can be decreased without decreasing the suction force of the through holes 142 which are blocked by the sheet P in the upstream area 201 and the downstream area 203. Accordingly, the suction force between the transport belt 140 and the sheet P in the upstream area 201 and the downstream area 203 can be sufficiently ensured to sufficiently suppress floating of the sheet P from the transport belt 140 and weaken airflow generated in the recording area 202, and thus an effect of the airflow on a flight state of ink droplets can be suppressed. This is particularly effective when borderless printing is performed for the front end or back end of the sheet P. Moreover, in the upstream area 201, this is effective from the viewpoint that the sheet P at the stage where the suction onto the transport belt 140 is started can be sucked onto the transport belt 140 in a short time.

In addition, in the downstream area 203, when the sheet P swollen by ink blocks the through holes 142, the sheet P can be sucked onto the transport belt 140 by a sufficient suction force. Accordingly, cockling of the sheet P swollen by ink and floating of the sheet P from the transport belt 140 can be suppressed. Variation in behavior caused in the sheet P by detachment of the sheet P from the transport belt 140 also can be suppressed.

In addition, in this embodiment, a channel cross-sectional area of some of the communication channels 180 is increased or decreased by the displacement of the diaphragms 271 by the differential pressure between the hole-side channel sections 262 and the suction-side channel sections 265. Accordingly, without the change in drive forces for the fans 148, 149 and 150, the suction force of the through holes 142 can be increased when the through holes 142 are blocked by the sheet P, and the suction force of the through holes 142 can be decreased when the through holes 142 are opened.

In this embodiment, a channel cross-sectional area of some of the communication channels 180 communicating with the opened through holes 142 is narrower in the recording area 202 than in the upstream area 201 and the downstream area 203. Accordingly, the suction force generated in the opened through holes 142 in the recording area 202 can be made weaker than that in the upstream area 201 and the downstream area 203.

In this embodiment, the hole diameters of the open communication holes 276 and 376 formed in the diaphragms 271 are smaller in the recording area 202 than in the upstream area 201 and the downstream area 203. Accordingly, a channel cross-sectional area of some of the communication channels 180 communicating with the opened through holes 142 in the recording area 202 can be made narrower than those in the upstream area 201 and the downstream area 203.

In this embodiment, some of the valves 263 are arranged in the upstream area 201 and the downstream area 203. Accordingly, in the upstream area 201 and the downstream area 203, the suction amounts from the opened through holes 142 can be decreased without decreasing the suction force of the through holes 142 blocked by the sheet P. Accordingly, in the upstream area 201 and the downstream area 203, the floating of the sheet P from the transport belt 140 can be sufficiently suppressed and airflow generated in the opened through holes 142 can be weakened to suppress an effect of the airflow on a flight state of ink droplets.

In this embodiment, the upstream chamber 158 and the recording area chamber 160 are arranged in the upstream area 201 and the recording area 202, respectively, and the fans 148 and 150 are provided to correspond to the chambers, respectively. Accordingly, a suction force generated in the through holes 142 blocked by the sheet P can be made stronger than in the case where a suction force is generated in the recording area chamber 160 and the upstream chamber 158 by one fan and thus the sheet P can be stably sucked onto the transport belt 140.

Similarly, the downstream chamber 159 and the recording area chamber 160 are arranged in the downstream area 203 and the recording area 202, respectively, and the fans 149 and 150 are provided to correspond to the chambers, respectively. Accordingly, a suction force generated in the through holes 142 blocked by the sheet P can be made stronger than in the case where a suction force is generated in the recording area chamber 160 and the downstream chamber 159 by one fan and thus the sheet P can be stably sucked onto the transport belt 140.

The transport belt 140 is an example of a support member. The through hole 142 is an example of a suction hole. A suction force of the through holes 142 not covered by the sheet P in the recording area 202 is an example of a second suction force. A suction force of the through holes 142 covered by the sheet P in the recording area 202 is an example of a first suction force. A portion supporting the sheet P in the recording area 202 of the transport belt 140 is an example of a first suction unit.

Suction forces of the through holes 142 not covered by the sheet P in the upstream area 201 and the downstream area 203 are an example of a third suction force. Portions supporting the sheet P in the upstream area 201 and the downstream area 203 of the transport belt 140 are an example of a second suction unit.

Figure 10:
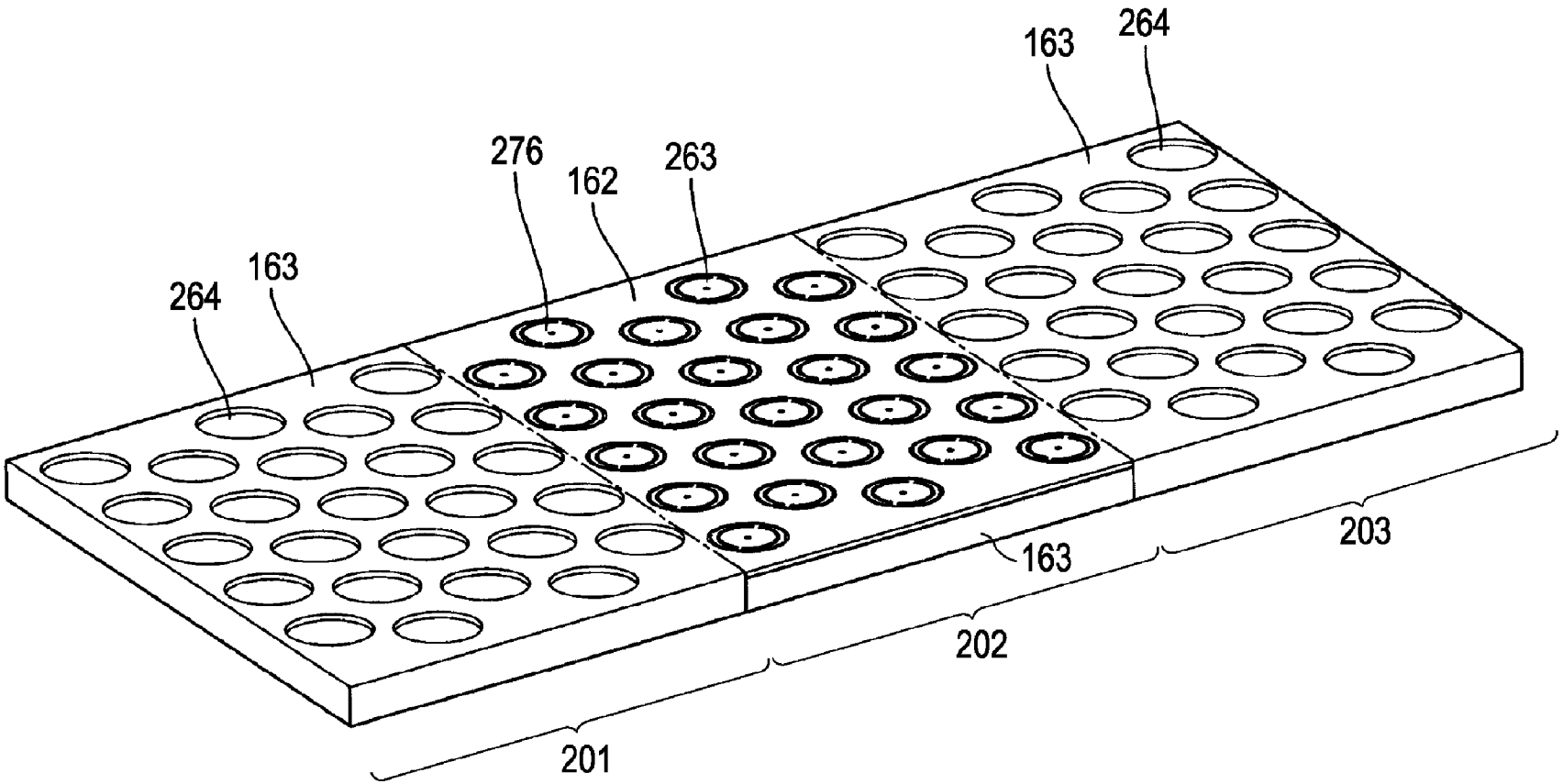
FIG. 10 is a perspective view illustrating a valve plate and a spacer plate disposed in a recording area chamber and spacer plates disposed in an upstream chamber and a downstream chamber.

Next, other embodiments will be described. The same components as in the above embodiment will be denoted by the same reference signs and a description thereof will be omitted. FIG. 10 is a perspective view illustrating the valve plate 162 and the spacer plate 163 disposed in the recording area chamber 160 and the spacer plates 163 disposed in the upstream chamber 158 and the downstream chamber 159. As illustrated in the drawing, the valve plate 162 is arranged in the recording area 202 and the valve plate 162 is not arranged in the upstream area 201 and the downstream area 203.

Figure 11A:
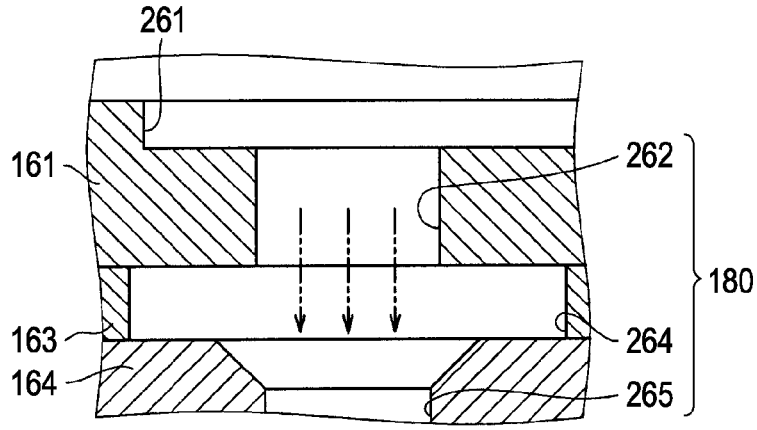
FIGS. 11A to 11C are partial sectional side views illustrating the upstream chamber, the recording area chamber and the downstream chamber.
Figure 11B:
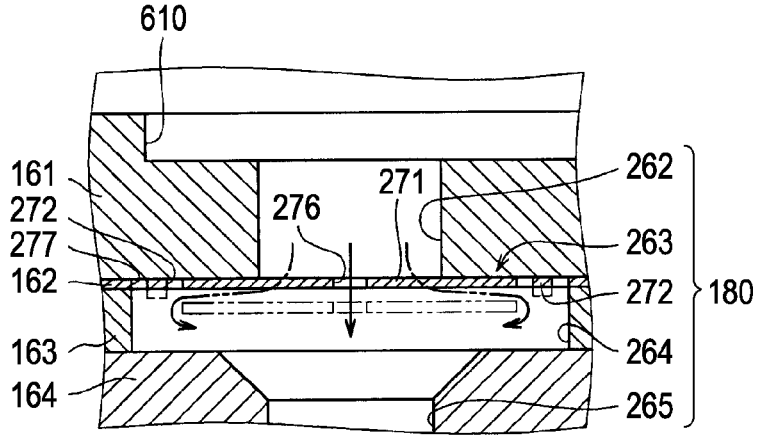
Figure 11C:
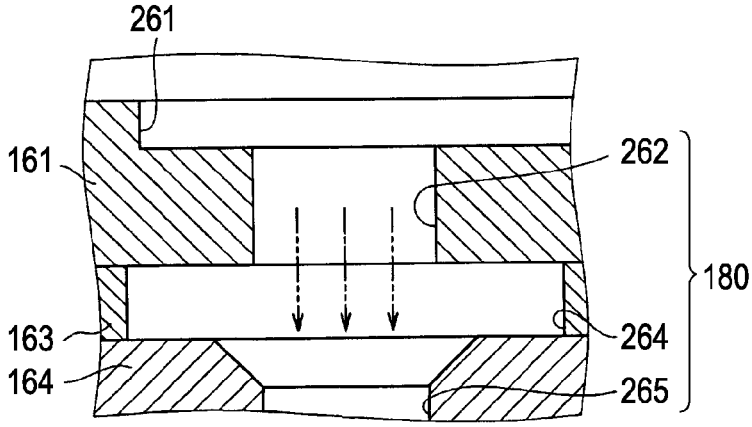

FIGS. 11A to 11C are partial sectional side views illustrating the upstream chamber 158, the recording area chamber 160 and the downstream chamber 159. As illustrated in FIGS. 9A and 9C, in the upstream chamber 158 and the downstream chamber 159, the valve plate 162 is not present between the belt receiving plate 161 and the spacer plate 163, so the valve chambers 264 have no valve 263. Accordingly, a channel cross-sectional area of the valve chambers 264 is constant regardless of whether the sheet P blocking the through holes 142 is present.

As illustrated in FIG. 11B, in the recording area 160, the valve plate 162 is present between the belt receiving plate 161 and the spacer plate 163, so the valves 263 are present in the valve chambers 264, respectively. Accordingly, a channel cross-sectional area of the valve chambers 264 increases when the through holes 142 are blocked by the sheet P and the channel cross-sectional area decreases when the through holes 142 are opened.

Accordingly, in the recording area 202, when the through holes 142 are opened, the suction amounts from the through holes 142 are decreased by the valves 263. On the other hand, in the upstream area 201, the suction force generated in the through holes 142 when the sheet P is transported to the vicinity of the through holes 142 is not decreased. Accordingly, airflow generated in the recording area 202 can be made weaker than airflow generated in the upstream area 201. In addition, in the upstream area 201, the suction force generated in the through holes 142 when the sheet P is transported to the vicinity of the through holes 142 can be made stronger than that in the recording area 202. Similarly, the airflow generated in the recording area 202 can be made weaker than the airflow generated in the downstream area 203. In the downstream area 203, the suction force generated in the through holes 142 when the sheet P is transported to the vicinity of the through holes 142 can be made stronger than that in the recording area 202.

In this embodiment, the valves 263 are not arranged in the upstream area 201 and the downstream area 203. However, the recording area 202 may be provided with a larger number of the valves 263 than in the upstream area 201 and the downstream area 203 and the valves 263 may be arranged in the upstream area 201 and the downstream chamber 203. In this case, the valves 263 may be arranged so that the number of the valves 263 gradually increases from the upstream side to the downstream side in the transport direction in the upstream area 201. Similarly, the valves 263 may be arranged so that the number of the valves 263 gradually decreases from the upstream side to the downstream side in the transport direction in the downstream area 203.

As described above, the embodiments of the invention have been described. However, the technical scope of the invention is not limited to the above description. It is obvious to those skilled in the art that various changes or modifications may be made to the embodiments. It is obvious from the claims that configurations to which such changes or modifications are made can be also included in the technical scope of the invention.

What is claimed is:

1. A recording device comprising:

a first suction unit which has a support member for supporting a recording medium and a plurality of suction holes provided in the support member to support the recording medium under control that a second suction force of the suction holes not covered by the recording medium is restricted to be smaller than a first suction force of the suction holes covered by the recording medium;

a recording head which performs recording on the recording medium supported by the first suction unit; and a second suction unit which has a support member for supporting a recording medium and a plurality of suction holes provided in the support member and is disposed near the first suction unit in a transport direction of the recording medium and in which a third suction force of the suction holes not covered by the recording medium is set to be larger than the second suction force, wherein the second suction unit is disposed on at least one of the upstream side and the downstream side of the first suction unit in the transport direction, wherein each of the first suction unit and the second suction unit has a plurality of communication channels communicating a suction force generating section which generates a suction force for sucking air with the suction holes, and a suction force adjusting section provided to correspond to the suction holes and restricting the first suction force to be smaller than the second suction force, wherein the communication channel has:

a hole-side channel section which is closer to the suction hole than the suction force adjusting section; and a suction-side channel section which is closer to the suction force generating section than the suction force adjusting section, wherein the suction force adjusting section has:

a diaphragm which is arranged between the hole-side channel section and the suction-side channel section and is displaced toward the hole-side channel section or the suction-side channel section by a differential pressure between the hole-side channel section and the suction-side channel section;

an open-close communication hole which is formed in the diaphragm, is opened and closed by the displacement of the diaphragm and communicates the hole-side channel section with the suction-side channel section in an opened state; and an open communication hole which is formed in the diaphragm, is opened regardless of the position of the diaphragm and communicates the hole-side channel section with the suction-side channel section.

2. The recording device according to claim 1, wherein each of the first suction unit and the second suction unit has a plurality of communication channels communicating a suction force generating section which generates a suction force for sucking air with the suction holes, and suction force adjusting sections provided to correspond to the suction holes and restricting the first suction force to be smaller than the second suction force, and wherein the number of the suction force adjusting sections of the first suction unit is larger than the number of the suction force adjusting sections of the second suction unit.

3. The recording device according to claim 1, further comprising a suction force generating section which generates a suction force for sucking air, wherein, each of the first suction unit and the second suction unit has a plurality of communication channels communicating the suction force generating section with the suction holes, and a suction force adjusting section provided to correspond to the suction holes and restricting the first suction force to be smaller than the second suction force, wherein the first suction unit has a first chamber in which the communication channels communicating with the suction holes are disposed, wherein the second suction unit has a second chamber in which the communication channels communicating with the suction holes are disposed, and wherein the suction force generating sections are provided to correspond to the first chamber and the second chamber, respectively.

4. A recording device comprising:

a first suction unit which has a support member for supporting a recording medium and a plurality of suction holes provided in the support member to support the recording medium under control that a second suction force of the suction holes not covered by the recording medium is restricted to be smaller than a first suction force of the suction holes covered by the recording medium;

a recording head which performs recording on the recording medium supported by the first suction unit; and a second suction unit which has a support member for supporting a recording medium and a plurality of suction holes provided in the support member and is disposed near the first suction unit in a transport direction of the recording medium and in which a third suction force of the suction holes not covered by the recording medium is set to be larger than the second suction force, wherein each of the first suction unit and the second suction unit has a plurality of communication channels communicating a suction force generating section which generates a suction force for sucking air with the suction holes, and a suction force adjusting section provided to correspond to the suction holes and restricting the first suction force to be smaller than the second suction force, wherein the communication channel has:

a hole-side channel section which is closer to the suction hole than the suction force adjusting section; and a suction-side channel section which is closer to the suction force generating section than the suction force adjusting section, wherein the suction force adjusting section has:

a diaphragm which is arranged between the hole-side channel section and the suction-side channel section and is displaced toward the hole-side channel section or the suction-side channel section by a differential pressure between the hole-side channel section and the suction-side channel section;

an open-close communication hole which is formed in the diaphragm, is opened and closed by the displacement of the diaphragm and communicates the hole-side channel section with the suction-side channel section in an opened state; and an open communication hole which is formed in the diaphragm, is opened regardless of the position of the diaphragm and communicates the hole-side channel section with the suction-side channel section, and wherein a hole diameter of the open communication hole of the first suction unit is smaller than a hole diameter of the open communication hole of the second suction unit.

* * * * *